US007536022B2

(12) United States Patent
Von Buol

(10) Patent No.: US 7,536,022 B2
(45) Date of Patent: May 19, 2009

(54) METHOD TO DETERMINE A FEEDBACK THRESHOLD IN A HEARING DEVICE

(75) Inventor: Andreas Von Buol, Zürich (CH)

(73) Assignee: Phonak AG, Stafa (CH)

( * ) Notice: Subject to any disclaimer, the term of this patent is extended or adjusted under 35 U.S.C. 154(b) by 577 days.

(21) Appl. No.: 11/224,791

(22) Filed: Sep. 13, 2005

(65) Prior Publication Data

US 2006/0050911 A1 Mar. 9, 2006

Related U.S. Application Data

(63) Continuation-in-part of application No. 10/263,126, filed on Oct. 2, 2002, now Pat. No. 7,010,135.

(51) Int. Cl.
*H04R 25/00* (2006.01)

(52) U.S. Cl. ..... 381/318; 381/321

(58) Field of Classification Search ..... 381/23.1, 381/56, 58, 60, 96, 107, 108, 312, 314, 318, 381/320, 321
See application file for complete search history.

(56) References Cited

U.S. PATENT DOCUMENTS 5,991,417 A * 11/1999 Topholm ..... 381/60
6,128,392 A 10/2000 Leysieffer et al. ..... 381/318
6,134,329 A 10/2000 Gao et al. ..... 381/60
6,219,427 B1 4/2001 Kates
6,404,895 B1 6/2002 Weidner ..... 381/318
2001/0002930 A1 6/2001 Kates ..... 381/317
2003/0012391 A1 1/2003 Armstrong et al. ..... 381/312
2004/0066946 A1 4/2004 Buol

FOREIGN PATENT DOCUMENTS

WO 00/21332 4/2000

* cited by examiner

*Primary Examiner*—Brian Ensey
(74) *Attorney, Agent, or Firm*—Pearne & Gordon LLP

(57) ABSTRACT

Provided is a hearing device and method for compensating for a hearing loss. To compensate for the hearing loss, the hearing device and method utilize the gain during feedback in the forward path of a compressive system which, after having reached its steady state in "closed loop" operation, is equal to the feedback threshold gain. The steady state is reached soon after having applied a low input signal level to the hearing device, which input signal level is below 55 dB SPL (Sound Pressure Level), for example, and would result, for the open loop compressive system, in a larger gain than the feedback threshold gain of the closed loop system, respectively, would result in the maximum possible hearing device gain if maximum possible hearing device gain is below feedback threshold gain. The signal feedback gain is assessed in this steady state.

21 Claims, 2 Drawing Sheets

METHOD TO DETERMINE A FEEDBACK THRESHOLD IN A HEARING DEVICE

CROSS-REFERENCE TO RELATED APPLICATIONS

This application is a Continuation-In-Part of U.S. application Ser. No. 10/263,126 filed Oct. 2, 2002.

TECHNICAL FIELD

This invention relates to the field of signal processing in hearing devices, and more particularly to a method to determine a feedback threshold in a hearing device.

BACKGROUND OF THE INVENTION

Hearing devices are electronic devices in which sound is recorded by a microphone, is processed or amplified, respectively, in a signal processing unit, and is transmitted into the ear canal of a hearing device user over a loudspeaker which is also called receiver. The amplified or processed sounds which are emitted by the receiver are partially recorded by the microphone. In other words, it must be dealt with a closed loop comprising a hearing device with an output signal and an input signal. It must be noted that the path of the sound energy is not limited to acoustic energy, but also comprises, as the case may be, a mechanical transmission from the output to the input, as e.g. over the housing of the hearing device (so-called body sound). Furthermore, one has realized that over a vent, which is actually used for pressure equalization between the inner ear of the hearing device user and the surrounding, or over electrical paths in the hearing device, signal feedback can occur. It has been shown that of all these possible components, the acoustic signal feedback-contributes the largest part.

The mentioned effects can result in a squealing for hearing devices, which squealing is very uncomfortable for the hearing device user and finally renders the hearing device unusable during the occurrence of the squealing. Although there exists the possibility to keep the gain in the hearing device so small that no buildup and therefore no squealing, which is a result of signal feedback, occurs. Therewith, the use of a hearing device is compromised, to be precise in particular for those applications, by which a large hearing loss must be compensated as it occurs for a person who is hard of hearing, because for such patients a comparatively large gain in the hearing device must be adjusted in order to obtain an adequate compensation.

In order that all gain settings, in particular the maximum possible gain setting, for a hearing device can be used in its full extent, it is absolutely necessary to determine the feedback threshold, which means to know the maximum gain setting for a hearing device, for which maximum gain setting there occurs only just no signal feedback.

Methods to determine the feedback threshold in a hearing device are already known. In U.S. Pat. No. 6,134,329, such a method is described with the aid of which the transfer function of the hearing device is estimated from measurements which are made with a hearing device inserted into the ear of a user. Thereby, the overall transfer function is calculated with different gain values without that the closed loop is being opened. Therewith, so-called optimal Wiener filter models are being used. The transfer function in the forward path and the one in the backward path are being calculated together in the following. From the transfer function in the forward path, the possible instable frequencies and the maximum gain settings can be determined in the hearing device. Furthermore, it is also disclosed how the transfer function in the forward path and the one in the backward path can be calculated from the measurements of the overall transfer function. For these measurements, an additional microphone is inserted into the ear canal of the hearing device user, the insertion being done into the hearing canal preferably through the vent.

It is obvious that these known methods ask for a large processing power in order to obtain the desired information. Furthermore, an additional microphone is being used for this variant, which is based on an in-situ measurement, by which the acoustical but also the mechanical characteristics of the overall system is being changed in a disadvantageous manner, such that, as a consequence thereof, errors will occur in the further calculations to determine the feedback threshold.

Furthermore, reference is made to U.S. Pat. No. 6,128,392 from which the use of a hearing device with a compensation filter in its feedback path in the form of a FIR-(Finite Impulse Response) filter is known. Acoustical and mechanical signal feedback shall be compensated, an impulse at the output of the hearing device being applied in order to determine the filter coefficients of the compensation filter. At the input of the hearing device, the impulse response is measured and the values for the coefficients are being determined for the compensation filter therefrom. It is an integrated signal feedback damping which has an influence on the overall transfer function of the hearing device partly in an undesirable manner because signal components of the desired signal are being damped at the same time.

For the sake of completeness, reference is made to a method to determine the signal feedback threshold, which method is applied in practice. The method consists therein that the gain in the hearing device will be increased step by step until signal feedback occurs. As a result, the corresponding value for the amplification, for which only just no signal feedback occurs, corresponds to the signal feedback threshold. This simple method has the great disadvantage that the hearing device user is exposed to high sound levels. Furthermore, the hearing device must produce a high power during the determination of the feedback threshold.

Therefore, it is an object of the present invention to provide a method which does not incorporate the disadvantages mentioned above.

SUMMARY OF THE INVENTION

The present invention uses the fact that the gain during feedback in the forward path of a compressive system, as it is the case for a hearing device used to compensate a hearing loss, after having reached its steady state in "closed loop" operation, is equal to the feedback threshold gain. The steady state is reached soon after having applied a low input signal level to the hearing device, which input signal level is below 55 dB SPL (Sound Pressure Level), for example, and would result, for the open loop compressive system, in a larger gain than the feedback threshold gain of the closed loop system, respectively, would result in the maximum possible hearing device gain if maximum possible hearing device gain is below feedback threshold gain. The signal feedback gain is assessed in this steady state.

In one embodiment of the present invention, a maximum gain is adjusted below the determined feedback threshold gain in the hearing device. By limiting the gain in the forward path to the determined maximum gain, feedback cannot occur in this system.

In case signal feedback does not occur for the presented input signal level, i.e. if the gain applied is too small to result in signal feedback, the maximum gain is set to the maximum gain applied during the test.

The step of assessing the feedback threshold gain can be performed in different ways assuming the steady state, as mentioned above, is reached:

First, the feedback threshold gain can be read out of the internal memory of a digital hearing device.

Second, the feedback threshold gain in the forward path can be determined by assessing, for example via a measurement, the levels of the input and the output signals of the hearing device, be it implemented using analog or digital technology.

Third, the damping in the backward path can be determined via measuring the levels of the input and the output signals of the hearing device, be it implemented as analog or digital hearing devices, the feedback threshold gain in the forward path being equal the damping in the backward path.

Fourth, the feedback threshold gain can be determined via the input signal provided by the microphone of the hearing device in combination with the gain model applied to the input signal.

It has already been pointed out that knowledge of the feedback threshold gain is of great importance. This is in particular true if the hearing device disposes over no efficient feedback canceling. But also in the case where a feedback canceling is available, knowledge of the feedback threshold is of great value. Thus, by the present invention, a possibility is given to improve the quality of the hearing device and/or the quality of the hearing, in particular for an in-the-ear device (ITE).

Furthermore, the present invention has at least one of the following advantages:

- The forward path does not have to be opened up to determine the feedback threshold gain; the assessment of the feedback threshold gain is carried out in closed-loop operation of the hearing device, and while the hearing device is inserted into the ear of the hearing device user.
- At the microphone input of the hearing device, no signal-to-noise ratio is necessary, i.e. for a given maximum sound pressure P at the ear and for a surrounding noise S, a maximum feedback threshold gain $V_{max}$ can be determined up to:

$$V_{KRIT}=P-S.$$

The known method needs a signal-to-noise distance DS at the microphone such that the feedback threshold gain can be determined up to a value of $$V_{KRIT}=P-(S+DS).$$

- For a given surround noise and for the same sound pressure at the ear during the determination of the feedback threshold gain, a higher maximum gain can be reached by the present invention;
- The method according to the present invention can be realized without or with only little additional expenditure with existing signal processing possibilities which are used in modern hearing devices.

In a further embodiment of the present invention, it is intended to carry out the assessment of the feedback threshold gain in different frequency bands in that a feedback threshold gain is determined in each frequency band.

In yet another embodiment of the present invention, the frequency bands correspond to the so-called critical frequency bands which are given by the structure of the human hearing. Critical frequency bands are frequency regions within which the ear groups together sounds of different frequency. Sounds spaced apart more than a critical band can be separately recognized by the brain, at least for normal-hearing people.

DETAILED DESCRIPTION OF THE INVENTION

Figure 1:
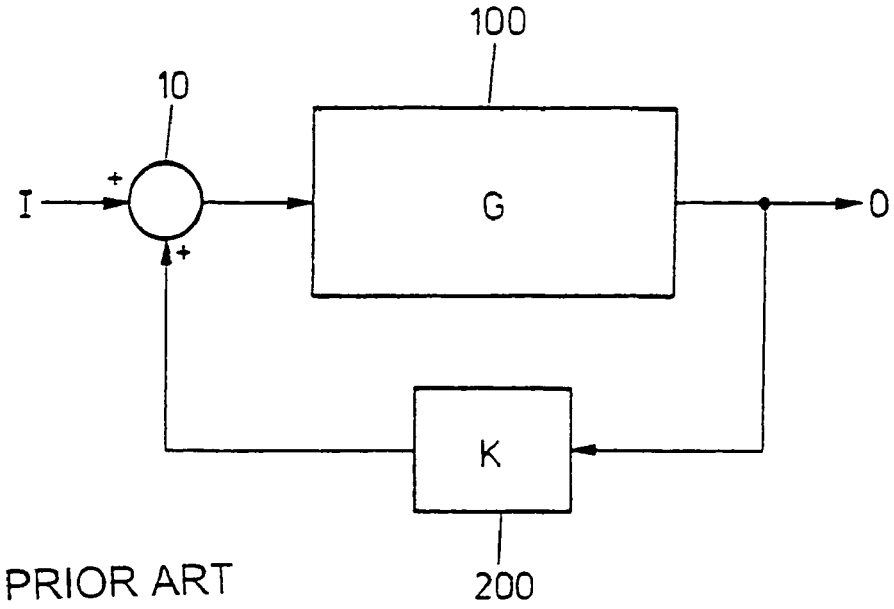
FIG. 1 is a block diagram of a known system having forward and backward paths.

FIG. 1 shows a block diagram for a feedback system as it is generally known. By 100, a processing unit having a transfer function G, and, by 200, a feedback unit having a transfer function K are identified. An input signal I is fed to one of the two inputs of an addition unit 10 of which the only output is fed to the processing unit 100. In the processing unit 100, an output signal O is generated that is fed to the second input of the addition unit 10 via the feedback unit 200, besides the circumstance that the output signal O is fed to the outside.

Having identified the transfer function in the forward and in the backward path by G and K, respectively, the following overall transfer function for the system according to FIG. 1 can be obtained as follows:

$$\frac{O}{I}=\frac{G}{1-K\cdot G}$$

Figure 2:
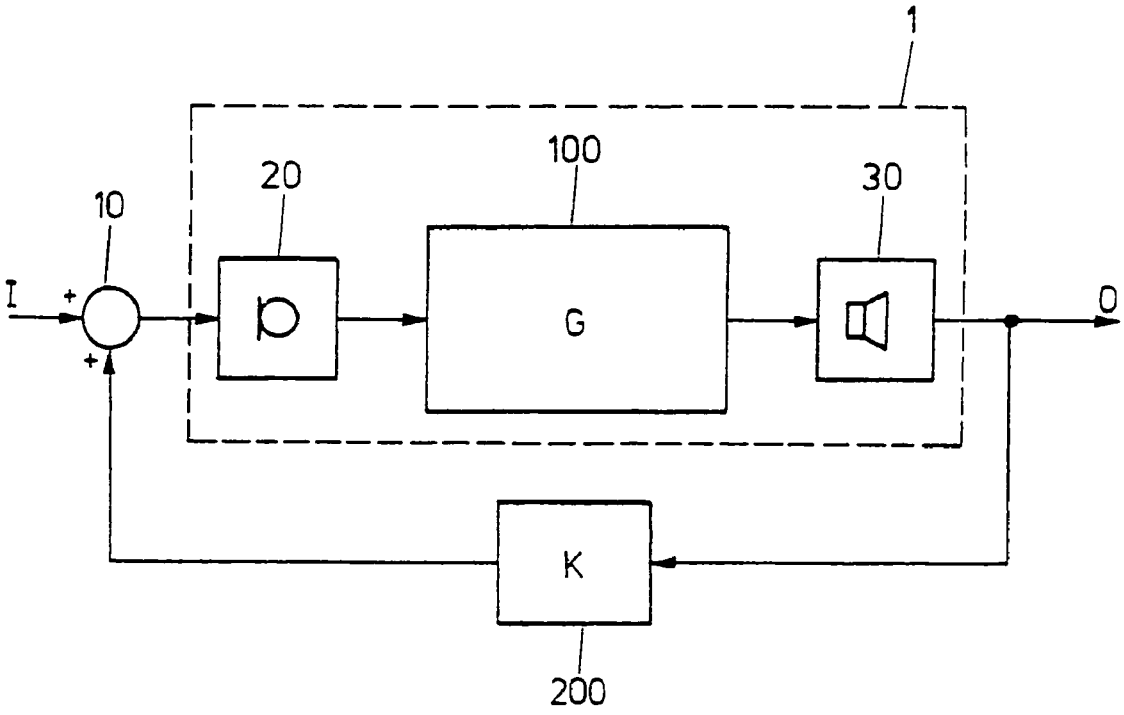
FIG. 2 is a block diagram of a hearing device with a backward path which represents all possible signal feedback for a hearing device.

FIG. 2 schematically shows a block diagram of a hearing device 1, comprising a processing unit 100 with a transfer function G. Seen from a propagation direction of signals in the hearing device, a loudspeaker 30, which is also called receiver in the technical field of hearing devices, is positioned after and connected to the processing unit 100, and a microphone 20 is positioned before and connected to the processing unit 100. The output signal of the hearing device 1, respectively of the receiver 30, is fed via a feedback unit 200 to an addition unit 10, to which also an input signal I is being fed. An output signal is generated in the addition unit 10, which output signal is fed to the microphone 20.

It is emphasized that FIG. 2 only represents a simplified structure of a hearing device in that only a microphone 20, a signal processing unit 100 and a receiver 30 are shown. In fact, other functional units—as e.g. other microphones, an analog-to-digital converter, observation units for observation of power supply, a digital-to-analog converter, memory units, etc.—might be provided. Such additional units do not have an impact on the concept of the present invention.

The feedback unit 200 having a transfer function K is the actual equivalent circuit for the effects mentioned above, of which the acoustic signal feedback contributes the largest part. In this connection, reference is made to the already said and to the general explanations in U.S. Pat. No. 6,134,329.

Apart from additional influences to the overall transfer function on the basis of specific transfer function characteristics of the microphone 20 and the receiver 30, the overall transfer function of the block diagram according to FIG. 2 is equal to the one according to FIG. 1.

Figure 3:
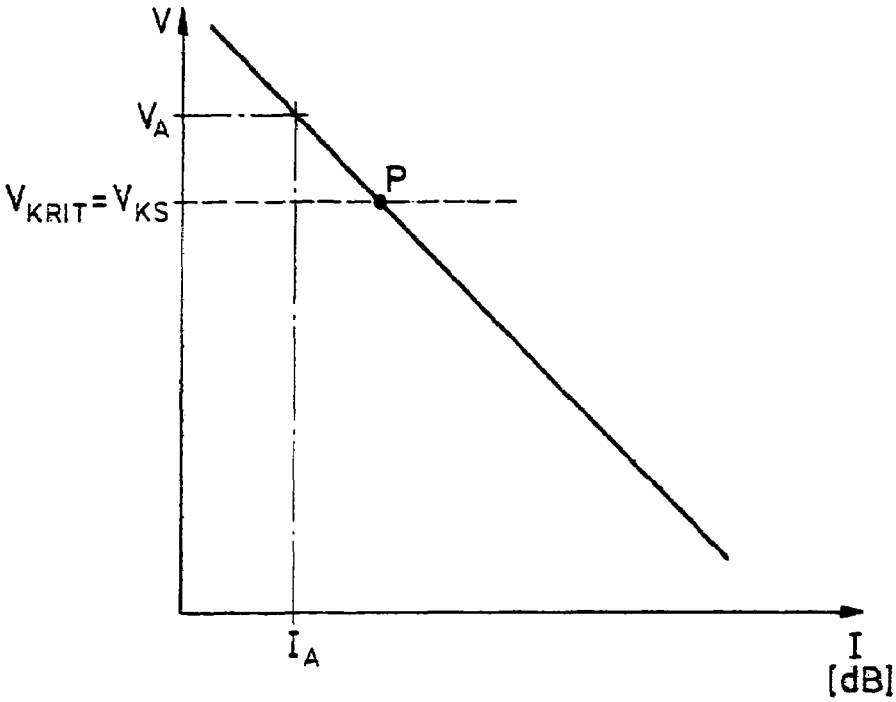
FIG. 3 represents a course of a gain for which the gain is drawn in function of an input level of a hearing device in double logarithmic representation.

FIG. 3 shows, in a schematic view, a course for the gain of a compressive system, as it is used in a hearing device to compensate a hearing loss. While on the horizontal axis the level of the input signal I is drawn using a logarithmic scale and the unit decibel (dB), on the vertical axis the gain V is drawn also by using a logarithmic representation. The course of the gain in function of the input signal level has a negative slope which is characteristic for a compressive system.

In case a compressive system is being used in the forward path, as it can be seen from FIG. 3 for the gain course as a function of the input signal level, and in case an input signal level $I_A$ results in a larger gain $V_A$ than a supposed, i.e. not yet known feedback threshold gain $V_{KRIT}$, the system will adjust to a steady state in which the gain in the forward path will be equal to the damping in the backward path. As already mentioned, the gain in the forward path will be equal to the feedback threshold gain $V_{KRIT}$. Therewith, the feedback threshold gain $V_{KRIT}$ can be assessed, according to the present invention, by assessing the gain in the forward path or the damping in the backward path, e.g. in one of the following ways:

- the feedback threshold gain $V_{KRIT}$ is assessed by reading out an internal memory unit of the hearing device representing the gain in the forward path;
- for an analog device, the feedback threshold gain $V_{KRIT}$ is assessed by measuring a steering parameter representing the gain in the forward path of the hearing device;
- the feedback threshold gain $V_{KRIT}$ in the forward path can be determined by assessing the levels of the input and the output signals of the hearing device;
- the damping in the backward path can be determined via measuring the levels of the input and the output signals of the hearing device, be it implemented as analog or digital hearing devices, the feedback threshold gain $V_{KRIT}$ in the forward path being equal the damping in the backward path;
- the feedback threshold gain $V_{KRIT}$ can be determined via the input signal provided by the microphone of the hearing device in combination with the gain model applied to the input signal.

Having determined the feedback threshold gain $V_{KRIT}$ by one of the methods mentioned above, a maximum gain $V_{max}$ is adjusted that is below the feedback threshold gain $V_{KRIT}$. Thereby, a signal feedback is prevented. The gain difference between the feedback threshold gain $V_{KRIT}$ and the maximum gain $V_{max}$ is selected as small as possible in order to obtain a maximum gain range for the hearing device user. On the other hand, it must be taken into account that other factors may influence the signal feedback occurrence. In particular for applications in which feedback threshold gains $V_{KRIT}$ are determined in different frequency bands, it should be assured that an overall gain applied in a particular frequency band is less than $V_{KRIT}$, the overall gain being determined by a superposition of a gain applied in the frequency band as well as all additional gain components resulting from overlapping of neighboring gain functions. Especially in the case where no feedback canceling is available, it is possible that signal feedback occurs due to dynamic changes in the feedback path, although the adjusted maximum gain $V_{max}$ has not been surpassed. In these situations, the maximum gain must be further reduced in relation to the feedback threshold gain $V_{KRIT}$ to account for the dynamic changes in the feedback path, reductions of $V_{max}$ typically between 4 dB and 8 dB below $V_{KRIT}$ may be applied.

In case signal feedback does not occur for the presented input signal level, i.e. if the gain applied is too small to result in signal feedback, the maximum gain $V_{max}$ is set to the maximum gain applied during the test.

In a further embodiment of the present invention it is provided to fix the slope of the course of gain V to −1 in a first phase in order to reach the steady state very fast which in turn results in obtaining the feedback threshold gain $V_{KRIT}$ very quickly. In a later second phase, a flatter slope—which means a slope which is less than −1—is selected for the course of the gain. As a result thereof, a higher exactness for the feedback threshold gain $V_{KRIT}$ is obtained.

In a still further embodiment of the present invention, it is intended to split the range of human hearing into different frequency bands in each of which a feedback threshold gain $V_{KRIT}$ is determined by applying one of the methods mentioned above. Thereby, it is feasible to determine feedback threshold gains $V_{KRIT}$ in one or several as well as in all frequency bands. In a preferred embodiment of the present invention, so-called critical frequency bands are used which are given by the structure of the human ear.

Figure 4:
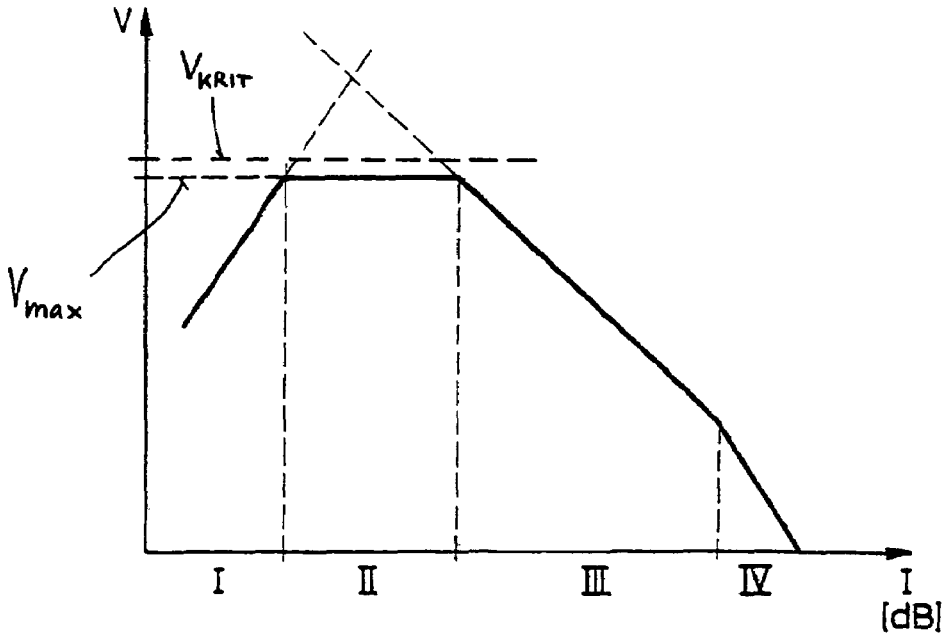
FIG. 4 is a further embodiment for a gain course as analogously represented in FIG. 3.

The invention will be further described by referring to FIG. 4 in which a gain course V is represented of a hearing device 1 using the same scaling as in FIG. 3. The gain course V corresponds to the one which is adjusted after the assessment of the feedback threshold gain $V_{KRIT}$ according to one of the above-mentioned methods, whereby four regions I, II, III and IV dividing the horizontal axis can be identified.

Region III is the compressive region in which a slope for a gain course is applied that is dependent on a specific hearing loss of a hearing device user. In order to prevent any feedback of the kind mentioned above, the gain course is essentially horizontal in region II at a gain level equal to the maximum gain $V_{max}$ which is below the feedback threshold gain $V_{KRIT}$ that has been determined in the manner described above. The level of the input signal I at the transition between region III and II is therefore derived from the feedback threshold gain $V_{KRIT}$ and the maximum gain $V_{max}$, respectively.

In region I, the gain course decreases towards lower levels of the input signal I in order to prevent noise from being amplified. The level of the input signal I at the transition between region I and II is set to a level at which noise influence increases.

In region IV, the gain course decreases towards higher levels of the input signal I in order to prevent very loud sound from being amplified. The level of the input signal I at the transition between region III and IV is set accordingly.

It is noted that while the level of the input signal I at the transition between region II and III is determined according to the procedures described above, all other levels of transitions are adjusted more heuristically.

According to the present invention, the gain course V is limited in region II with the aid of a limiting unit provided in the hearing device in order to limit the gain to the maximum gain $V_{max}$, thereby preventing signal feedback.

The present invention opens up a number of applications or uses, some of which have already been discussed above. In addition, or as a repetition, these are the following, for example:

- A maximum gain is adjusted below the determined feedback threshold gain in the hearing device. By limiting the gain in the forward path to the determined maximum gain, feedback cannot occur in this system.
- The assessed feedback threshold gain is used as parameter for steering an active feedback canceling unit, wherein the feedback unit is generally known in the art.

The assessed feedback threshold gain is used to estimate other acoustical coupling parameters related to the feedback threshold while the hearing device is inserted into an ear of a hearing device user. In particular, the assessed feedback threshold is used to improve an estimation of the real-ear-to-coupler difference.

The invention claimed is:

1. A method to determine a maximum gain in a hearing device comprising a forward path between an input and an output of the hearing device, a compressive gain model being applied in the forward path, the method comprising the steps of:

receiving with the hearing device a low input signal level introduced to the hearing device while the hearing device is inserted into an ear of a hearing device user, and assessing a feedback threshold gain after a steady state has been reached in the hearing device.

2. The method of claim 1, wherein the step of assessing the feedback threshold gain is carried out by determining a current gain in the forward path.

3. The method of claim 2, wherein the current gain is read out of a memory unit contained in the hearing device.

4. The method of claim 1, wherein the step of assessing the feedback threshold gain is carried out by assessing input and output signal levels, and by dividing the output signal level by the input signal level.

5. The method of claim 1, wherein the step of assessing the feedback threshold gain is carried out by measuring a gain in the forward path of the hearing device.

6. The method of claim 1, further comprising the step of assessing feedback threshold gains in at least two frequency bands.

7. The method of claim 1 further comprising applying a maximum gain in the forward path, wherein said maximum gain is adjusted below the feedback threshold gain.

8. The method of claim 1 further comprising steering a feedback canceling unit based at least in part on a parameter including the assessed feedback threshold gain.

9. The method of claim 1 wherein assessed feedback threshold gain is used to estimate another acoustical coupling parameter related to the feedback threshold while the hearing device is inserted into an ear of a hearing device user.

10. The method of claim 9 wherein the feedback threshold is used to improve an estimation of the real-ear-to-coupler difference.

11. A hearing device comprising a forward path between an input and an output and a gain model being applied in the forward path, said gain model having a maximum gain, means for assessing a feedback threshold gain after a steady state has been reached in the hearing device, and means for adjusting the maximum gain below the feedback threshold gain.

12. The method of claim 1, wherein the low input signal level is below 55 dB SPL.

13. A method to determine a maximum gain in a hearing device comprising a forward path between an input and an output of the hearing device, a compressive gain model being applied in the forward path, the method comprising the steps of:

reading a current gain out of a memory unit contained in the hearing device, wherein the current gain is determined by one or more steering parameters of the hearing device allowing to assess or directly representing the gain in the forward path of the hearing device;

exposing the hearing device to a low input signal level, while the hearing device is inserted into an ear of a hearing device user; and assessing a feedback threshold gain after a steady state has been reached in the hearing device.

14. A method to determine a maximum gain in a hearing device comprising a forward path between an input and an output of the hearing device, a compressive gain model being applied in the forward path, the method comprising the steps of:

exposing the hearing device to a low input signal level, while the hearing device is inserted into an ear of a hearing device user; and assessing a feedback threshold gain after a steady state has been reached in the hearing device, wherein assessing the feedback threshold gain is carried out by measuring a damping between an output and an input signal level of the hearing device.

15. A method to determine a maximum gain in a hearing device comprising a forward path between an input and an output of the hearing device, a compressive gain model being applied in the forward path, the method comprising the steps of:

exposing the hearing device to a low input signal level, while the hearing device is inserted into an ear of a hearing device user; and assessing a feedback threshold gain after a steady state has been reached in the hearing device, wherein assessing the feedback threshold gain is carried out by measuring an input signal level and by applying the gain model of the hearing device to the input signal level.

16. A method to determine a maximum gain in a hearing device comprising a forward path between an input and an output of the hearing device, a compressive gain model being applied in the forward path, the method comprising the steps of:

exposing the hearing device to a low input signal level, while the hearing device is inserted into an ear of a hearing device user;

assessing a feedback threshold gain after a steady state has been reached in the hearing device; and adjusting a course of a gain as a function of a level of the input signal in the hearing device as a slope steeper than −0.7 for the course of gain represented double-logarithmically.

17. A method to determine a maximum gain in a hearing device comprising a forward path between an input and an output of the hearing device, a compressive gain model being applied in the forward path, the method comprising the steps of:

exposing the hearing device to a low input signal level, while the hearing device is inserted into an ear of a hearing device user;

assessing a feedback threshold gain after a steady state has been reached in the hearing device; and adjusting a course of a gain as a function of a level of the input signal in the hearing device, wherein adjusting the course of the gain comprises:

choosing a slope steeper than −0.7 for the course of gain represented double-logarithmically in a first phase; and choosing a slope less than −1 for the course of gain represented double-logarithmically in a second phase.

18. The method according to claim 1 further comprising, responsive to assessing the feedback threshold gain after the steady state has been reached, establishing the feedback threshold gain as a gain in the forward path between the input and output of the hearing device.

19. The method according to claim 1 further comprising, responsive to assessing the feedback threshold gain after the steady state has been reached, establishing a maximum value of a gain in the forward path between the input and output of the hearing device that is less than the feedback threshold gain.

20. The method according to claim 19, wherein the gain in the forward path falls within a range from about 4 dB to about 8 dB less than the feedback threshold gain.

21. The method according to claim 1 further comprising:

determining that a gain applied in the forward path in response to the low input signal level is greater than the feedback threshold gain; and responsive to said determining, adjusting the gain applied in the forward path to a steady state value that is equal to a value of damping in a backward path provided to the hearing device.

* * * * *